US008596088B2

(12) United States Patent
Sato

(10) Patent No.: US 8,596,088 B2
(45) Date of Patent: Dec. 3, 2013

(54) OIL SEPARATOR FOR AIR CONDITIONER

(75) Inventor: Toshiyuki Sato, Kiyosu (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 478 days.

(21) Appl. No.: 12/728,534

(22) Filed: Mar. 22, 2010

(65) Prior Publication Data

US 2010/0300139 A1 Dec. 2, 2010

(30) Foreign Application Priority Data

May 28, 2009 (JP) ..... 2009-129425

(51) Int. Cl.
*F25B 43/02* (2006.01)

(52) U.S. Cl.
USPC ..... 62/470; 62/84; 62/468; 62/475; 62/473; 62/503

(58) Field of Classification Search
USPC ..... 62/470, 434, 468, 473, 475, 503, 84
See application file for complete search history.

(56) References Cited

U.S. PATENT DOCUMENTS

| | | | | | |
|---|---|---|---|---|---|
| 2,749,723 | A | * | 6/1956 | Webber | 62/470 |
| 3,283,532 | A | * | 11/1966 | Kocher | 62/473 |
| 5,113,671 | A | * | 5/1992 | Westermeyer | 62/468 |
| 5,404,730 | A | * | 4/1995 | Westermeyer | 62/470 |

FOREIGN PATENT DOCUMENTS

| | | | | |
|---|---|---|---|---|
| JP | 6-323487 | | | 11/1994 |
| JP | 7-12080 | | | 1/1995 |
| JP | 09079699 | A | * | 3/1997 |
| JP | 2001-124420 | A | | 5/2001 |
| JP | 2004-36778 | | | 2/2004 |
| JP | 2006-84102 | A | | 3/2006 |
| JP | 2007154830 | A | * | 6/2007 |
| JP | 2008175066 | A | * | 7/2008 |
| JP | 2009-74756 | A | | 4/2009 |

OTHER PUBLICATIONS

Office Action issued May 28, 2013, in Japanese Patent Application No. 2009-129425 with English translation.

* cited by examiner

*Primary Examiner* — Cheryl J Tyler
*Assistant Examiner* — Ana Vazquez
(74) *Attorney, Agent, or Firm* — Oblon, Spivak, McClelland, Maier & Neustadt, L.L.P.

(57) ABSTRACT

An oil separator for an air conditioner, which includes: a case having a cylinder portion, and a lid portion and a bottom portion respectively closing an upper side opening end and a lower side opening end of the cylinder portion; an inlet pipe which is connectable to a discharging outlet of a compressor and which penetrates the lid portion so that an end of the inlet pipe is located inside the case; an outlet pipe which is connectable to a condenser and which penetrates the lid portion so that an end portion of the outlet pipe is located inside the case and protrudes into the cylinder portion toward the bottom portion; and a mesh portion which is provided to the end of the inlet pipe.

14 Claims, 2 Drawing Sheets

OIL SEPARATOR FOR AIR CONDITIONER

CROSS REFERENCE TO RELATED APPLICATION

This application is based on and claims priority under 35 U.S.C. §119 to Japanese Patent Application No. 2009-129425 filed on May 28, 2009, the entire content of which is incorporated herein by reference.

TECHNICAL FIELD

The present disclosure relates to an oil separator for an air conditioner.

BACKGROUND ART

Various attempts have been made to reduce a discharging pulsation or an air column oscillation of a compressor, thereby suppressing noise. For example, JP-A-2004-36778 discloses a pressure pulsation absorption apparatus, in which a porous material is filled within a side branch branched from a main pipe to form a pulsation absorber. The apparatus can reduce a pressure pulsation (discharging pulsation) by a viscous resistance when a pressure liquid passes through continuous clearance of the pulsation absorber. JP-A-7-12080 discloses a silencing apparatus for a compressor, in which a silencer is disposed in a refrigerant piping (discharging piping of a compressor) to reduce amplitude of a pressure pulsation discharged from a compressing portion of the compressor. JP-A-6-323487 discloses a pulsation attenuator. To attenuate a pressure pulsation propagating in a pipe (discharging piping of the compressor) connected to a pulsation source, the attenuator has a branched piping which is connected to the discharging piping for a pressure switch and which has a diameter substantially equal to a diameter of the discharging piping. A part of the branched piping forms a side branch type muffler.

However, the attempts in JP-A-2004-36778 and JP-A-7-12080 require additional components (pulsation absorber and silencer) to reduce the discharging pulsation or the air column oscillation of the compressor, resulting in the increased numbers of the components and manufacturing processes.

The attempt in JP-A-6-323487 is advantageous in that a circuit structure remains unchanged by the use of an existing branched piping. However, since it is necessary to set the diameter of the branched piping identical to that of the piping connected to the pulsation source, the space required for arranging the circuit structure is increased inevitably.

A need thus exists for an apparatus which is not susceptible to the drawback mentioned above.

SUMMARY

Under the above-mentioned circumstance and/or other circumstances, the present disclosure can provide, at least, an oil separator for an air conditioner, which includes: a case having a cylinder portion, and a lid portion and a bottom portion respectively closing an upper side opening end and a lower side opening end of the cylinder portion; an inlet pipe which is connectable to a discharging outlet of a compressor and which penetrates the lid portion so that an end of the inlet pipe is located inside the case; an outlet pipe which is connectable to a condenser and which penetrates the lid portion so that an end portion of the outlet pipe is located inside the case and protrudes into the cylinder portion toward the bottom portion; and a mesh portion which is provided to the end of the inlet pipe.

Accordingly, as one of advantages, the present disclosure can provide an oil separator for an air conditioner, which can reduce a discharging pulsation or an air column oscillation of the compressor with a simple arrangement.

The above-mentioned advantage and other advantages will be discussed in detail with reference to the accompanying drawings.

DESCRIPTION OF THE PREFERRED EMBODIMENT

Hereinafter, an embodiment disclosed here will be described based on the drawings.

Figure 1:
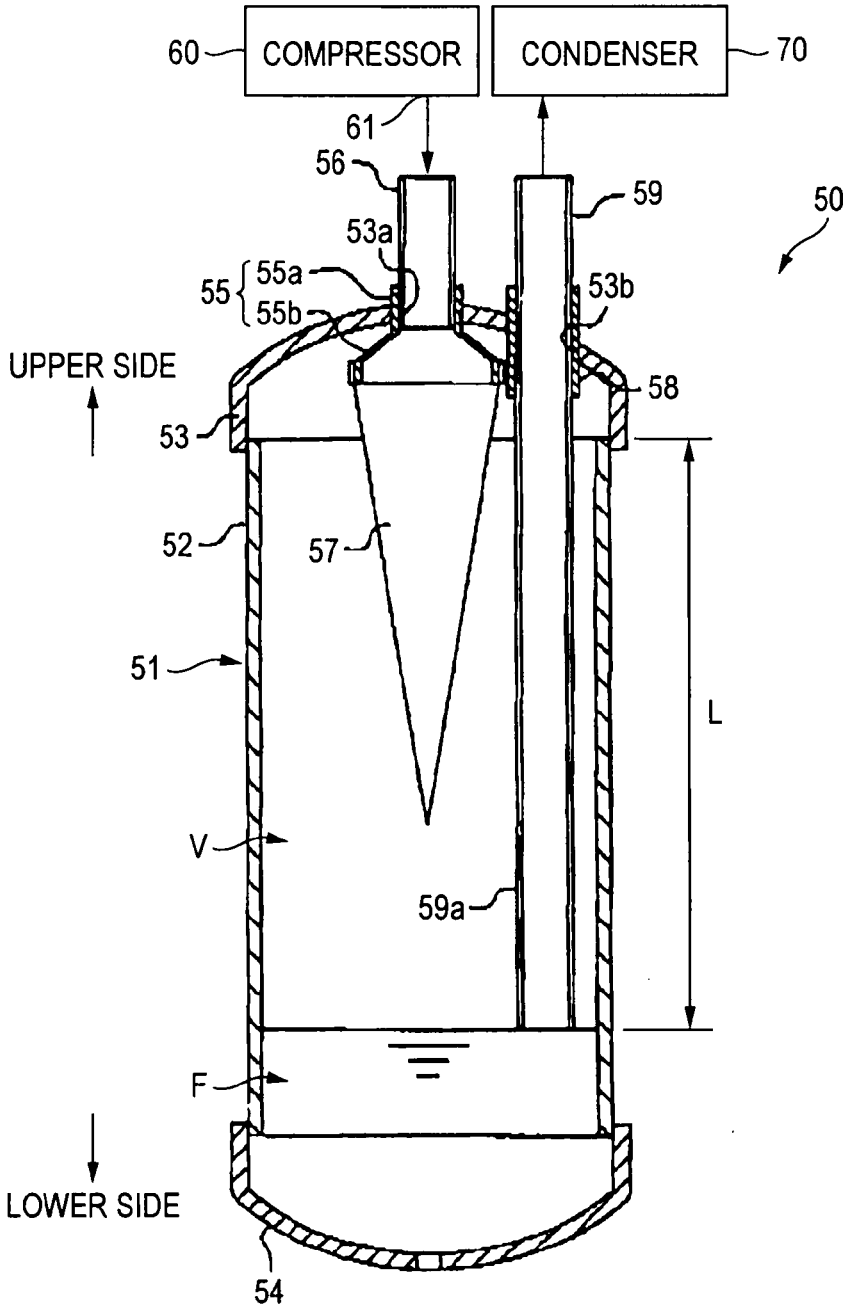
FIG. 1 is a longitudinal sectional view that shows an oil separator for an air conditioner.

FIG. 1 is a longitudinal sectional view that shows an oil separator of an air conditioner. As shown in FIG. 1, an oil separator 50 includes a case 51 forming an outer appearance of the separator 50. The case 51 has a cylindrical cylinder portion 52, and a lid portion 53 and a bottom portion 54 which are substantially bowl-shaped and which respectively close an upper side opening end and a lower side opening end of the cylindrical cylinder portion 52. The lid portion 53 has a circular hole 53*a* penetrating the center portion thereof and a circular hole 53*b* penetrating the outer peripheral portion adjacent to the circular hole 53*a*.

An enlarged-diameter-piping 55 is attached to the circular hole 53*a*. The enlarged-diameter-piping 55 has a cylindrical connecting portion 55*a* which is pressure-inserted and thus and fixed to the circular hole 53*a*. The enlarged-diameter-piping 55 has an enlarged-diameter-portion 55*b* which is connected to the connecting portion 55*a* within the case 51 and is gradually enlarged in diameter toward the lower part. Furthermore, a cylindrical inlet pipe 56 is pressure-inserted and thus fixed to the connecting portion 55*a*. The cylindrical inlet pipe 56 is connected to a discharging outlet 61 of a compressor 60 for compressing the refrigerant. A mesh member 57 is fixedly attached to an opening end portion (lower end portion) of the enlarged-diameter-portion 55*b*. The mesh member is, for example, a metallic net and is formed in a cone shape that is tapered toward the bottom. That is to say, the inlet pipe 56 penetrates the lid portion 53 so that an end of the inlet pipe 56 is located inside the case 51, and the mesh portion 57 communicates via the enlarged-diameter-piping 55 with the end of the inlet pipe 56 located inside the case 51. A lubricant oil of the compressor 60 is discharged from the compressor 60 along with the refrigerant, and the lubricant oil mixed in the refrigerant is sprayed onto the mesh portion 57, so that the mesh portion 57 drops the lubricant oil within the case 51. As a result, the lubricant oil mixed in the refrigerant is separated therefrom, and accumulated as a lubricant oil F within the case 51.

A cylindrical guide sleeve 58 is pressure-inserted and thus fixed to the circular hole 53*b*. A cylindrical outlet pipe 59 is pressure-inserted and thus fixed to the guide sleeve 58. The outlet pipe 59 is connected to a condenser 70 (for example, an outdoor heat exchanger during cooling operation, and an indoor heat exchanger during heating operation) for condensing the refrigerant. The outlet pipe 59 penetrates the lid portion 53 (guide sleeve 58) so that an end portion 59*a* of the outlet pipe 59 is located inside the case 51. The front end portion 59*a* of the outlet pipe 59 protrudes into the cylinder portion 52 toward the bottom portion 54. The outlet pipe 59 discharges the lubricant oil F within the case 51, which has reached the opening end (lower end) of the end portion 59*a*, to the condenser 70.

Thus, within the case 51, a space volume V in which the lubricant oil is not filled is secured in the upper part from the opening end of the end portion 59*a*. In particular, the reduction of the cost is promoted by eliminating a partition plate (not shown) from the inside of the case 51, and the space volume V is more reliably secured by disposing the mesh portion 57 in the center portion of the case 51. Due to the buffer effect of the space volume V, the discharging pulsation or the air column oscillation of the compressor 60 is reduced.

Figure 2:
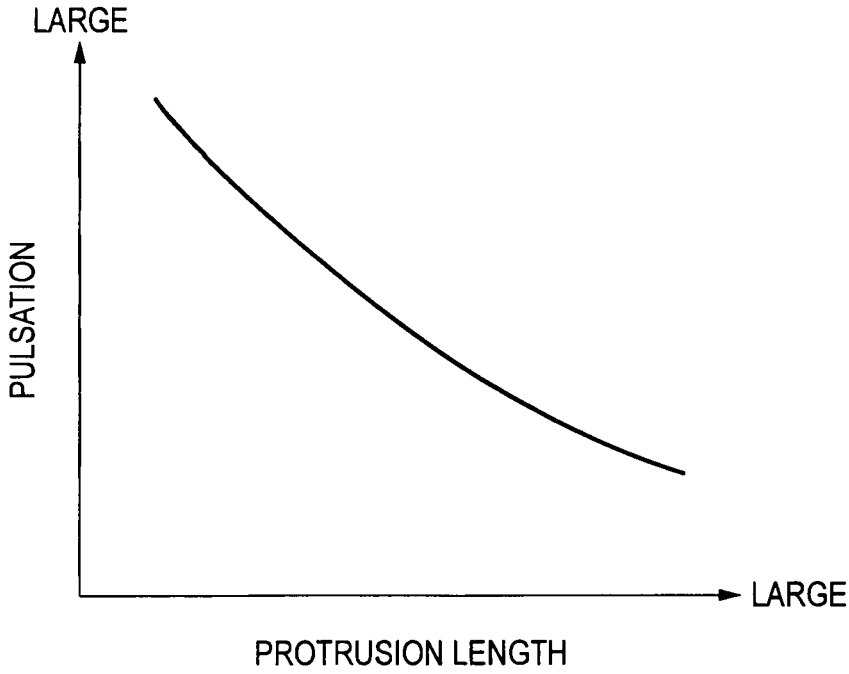
FIG. 2 is a graph that shows a relationship of a protrusion length and a discharging pulsation (pressure pulsation).

Herein, FIG. 2 is a graph that shows the relationship of the protrusion length L of the outlet pipe 59 into the cylinder portion 52 and the discharging pulsation (or air column oscillation) of the compressor 60. As is apparent from FIG. 2, the extent that the protrusion length L is made long, namely, to the extent that the space volume V is secured to be large to make the buffer effect more efficient, it is possible to reduce the discharging pulsation or the air column oscillation of the compressor 60. In addition, the protrusion length L correlates with the volume of the lubricant oil F that can be accumulated in the case 51, and the longer the protrusion length L is, the smaller the volume of the lubricant oil F becomes. If the volume of the lubricant oil F becomes small, the flow rate of the lubricant oil discharged to the condenser 70 is increased to that extent, which may deteriorate the performance of the air conditioner. In the present embodiment, under the condition that the volume of the lubricant oil F is secured such that the performance of the air conditioner can be maintained, the protrusion length L is made longer.

As described above, according to the present embodiment, the following effects can be obtained.

(1) In the present embodiment, the discharging pulsation or the air column oscillation of the compressor 60 can be reduced due to the buffer effect of the space volume V. In this case, since the oil separator 50 is the existing component of the air conditioner, the case 51 that regulates the arrangement space thereof also needs not to be changed in shape, and it is suffices that the end portion 59*a* of the outlet pipe 59 is protruded into the cylinder portion 52 toward the bottom portion 54, it is possible to reduce the discharging pulsation or the air column oscillation of the compressor 60 without increasing the numbers of components, the number of manufacturing processes and the arrangement spaces. It is also possible to suppress the increase in costs which is necessary for reducing the discharging pulsation or the air column oscillation of the compressor 60.

(2) In the present embodiment, since the air column oscillation of the long wavelength according to the space volume V can be reduced due to the buffer effect of the space volume V, it is possible to drive the compressor 60 at a lower rotation range without deteriorating the noise occurrence.

In addition, the above-described embodiment may be changed as follows.

In the above-described embodiment, there may be a plurality of compressors 60 in which the discharging outlet 61 is connected to the inlet pipe 56. In this case, any one of the plurality of compressors 60 is driven at a rotation speed different from other compressors to simultaneously generate the discharging pulsations having the different frequencies intentionally, thereby suppressing an occurrence of a stationary wave which is a cause of a noise. Specifically, in a case where the plurality of compressors 60 is connected to the same driving source (engine or the like), a speed transmission ratio (e.g., a pulley diameter in a belt transmission) between the driving source and the plurality of compressors may be set to be different from each other.

In the above-describe embodiment, any one of the lid portion 53 and the bottom portion 54 may be formed integrally with the cylinder portion 52.

In the above-described embodiment, the space volume V (protrusion length L) may be suitably set depending on the air column oscillation wavelength (rotation speed of the compressor) to be reduced.

As discussed above, the present disclosure can provide at least the following illustrative, non-limiting embodiments:

(1) An oil separator for an air conditioner, which includes: a case having a cylinder portion, and a lid portion and a bottom portion respectively closing an upper side opening end and a lower side opening end of the cylinder portion; an inlet pipe which is connected to a discharging outlet of the compressor for compressing a refrigerant and which penetrates the lid portion so that an end of the inlet pipe is located inside the case; an outlet pipe which is connected to a condenser for condensing the refrigerant and which penetrates the lid portion so that an end portion of the outlet pipe is located inside the case; and a mesh portion which is provided to the end of the inlet pipe and which drops a lubricant oil of the compressor within the case when the lubricant oil mixing in the refrigerant is sprayed onto the mesh portion, and wherein the end portion of the outlet pipe protrudes into the cylinder portion toward the bottom portion, whereby the lubricant oil within the case, which reaches an opening end of the front end portion is discharged via the outlet pipe to the condenser.

(2) The oil separator of (1), in which the mesh portion is provided in a center of the lid portion.

(3) The oil separator of (1) or (2), in which the mesh portion is supported by an enlarged-diameter-piping pressure-inserted to a hole formed through the lid portion.

(4) The oil separator of any one of (1) to (3), in which the mesh portion has a cone shape tapered toward the bottom portion.

(5) The oil separator of any one of (1) to (4), in which the mesh portion includes a metallic net.

(6) The oil separator of any one of (1) to (5), in which when the lubricant oil mixing in the refrigerant is sprayed onto the mesh portion, the mesh portion separates the lubricant from the refrigerant to drop the lubricant oil.

(7) The oil separator of any one of (1) to (6), in which the outlet pipe is fixed to the case via a guide sleeve.

(8) The oil separator of any one of (1) to (7), in which the lubricant oil is accumulated in a lower part of the case below the outlet pipe and a space volume is provided in an upper part of the case.

(9) The oil separator of any one of (1) to (8), in which the end portion of the outlet pipe is elongated to a part of the case below the mesh portion.

(10) The oil separator of any one of (1) to (9), in which the inlet pipe and the outlet pipe are juxtaposed to each other.

According to the oil separator of (1), the end portion of the outlet pipe protrudes into the cylinder portion toward the bottom portion, so that the lubricant oil within the case, which reaches the opening end of the end portion of the outlet pip is discharged via the outlet pipe to the condenser. Thus, within the case, the space volume in which the lubricant oil is not filled is secured in the upper part of the case above the opening end of the end portion of the outlet pipe. Therefore, the discharging pulsation or the air column oscillation of the compressor can be reduced due to a buffer effect of the space volume. In this case, the oil separator is an existing component of the air conditioner, the shape of the case which regulates the arrangement space thereof needs not to be changed, and it is sufficient that the end portion of the outlet pipe protrudes into the cylinder portion toward the bottom portion. Thus, it is possible to reduce a discharging pulsation or the air column oscillation of the compressor without increasing the numbers of the components, the numbers of the manufacturing processes and the arrangement spaces.

The principles, preferred embodiment and mode of operation of the present invention have been described in the forgoing specification. However, the invention which is intended to be protected is not be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

What is claimed is:

1. An oil separator for an air conditioner, comprising:

a case having a cylinder portion, and a lid portion and a bottom portion respectively closing an upper side opening end and a lower side opening end of the cylinder portion;

an inlet pipe which is connected to a discharging outlet of a compressor for compressing a refrigerant and which penetrates the lid portion so that an end of the inlet pipe is located inside the case;

an outlet pipe which is connected to a condenser for condensing the refrigerant and which penetrates the lid portion so that an end portion of the outlet pipe is located inside the case;

a mesh portion which is provided to the end of the inlet pipe and which drops a lubricant oil of the compressor towards a lower part of the case when the lubricant oil mixing in the refrigerant is sprayed onto the mesh portion; and a space volume in an upper part of the case that reduces a discharging pulsation or an air column oscillation of the compressor, wherein the end portion of the outlet pipe protrudes into the cylinder portion toward the bottom portion, whereby the lubricant oil accumulated in the lower part of the case that contacts an opening end of the end portion is discharged via the outlet pipe to the condenser, wherein the lubricant oil that contacts the opening end of the end portion of the outlet pipe does not flow to the compressor before being discharged to the condenser, and wherein a length of the outlet pipe extending below the lid portion is configured to maintain a size of the space volume to reduce the discharging pulsation or the air column oscillation of the compressor.

2. The oil separator according to claim 1, wherein the mesh portion is provided in a center of the lid portion.

3. The oil separator according to claim 1, wherein the mesh portion is supported by an enlarged-diameter-piping pressure-inserted to a hole formed through the lid portion.

4. The oil separator according to claim 1, wherein the mesh portion has a cone shape tapered toward the bottom portion.

5. The oil separator according to claim 1, wherein the mesh portion includes a metallic net.

6. The oil separator according to claim 1, wherein when the lubricant oil mixing in the refrigerant is sprayed onto the mesh portion, the mesh portion separates the lubricant from the refrigerant to drop the lubricant oil toward the lower part of the case.

7. The oil separator according to claim 1, wherein the outlet pipe is fixed to the case via a guide sleeve.

8. The oil separator according to claim 1, wherein the lubricant oil accumulates in the lower part of the case below the outlet pipe.

9. The oil separator according to claim 8, wherein a surface of the lubricant oil that accumulates in the lower part of the case defines a bottom end of the space volume.

10. The oil separator according to claim 9, wherein the bottom end of the space volume is at a location of the opening end of the end portion of the outlet pipe.

11. The oil separator according to claim 8, wherein the length of the outlet pipe defines a location of a surface of the lubricant oil accumulated in the lower part of the case.

12. The oil separator according to claim 1, wherein the end portion of the outlet pipe is elongated to a part of the case below the mesh portion.

13. The oil separator according to claim 1, wherein the inlet pipe and the outlet pipe are juxtaposed to each other.

14. The oil separator according to claim 1, wherein the condenser is directly connected to the outlet pipe.

* * * * *